United States Patent [19]

Pechner

[11] 4,185,480

[45] Jan. 29, 1980

[54] KEY-OPERATED PIN TUMBLER LOCK

[76] Inventor: Julius Pechner, 16010 Blackhawk St., Granada Hills, Calif. 91344

[21] Appl. No.: 891,609

[22] Filed: Mar. 30, 1978

[51] Int. Cl.[2] ..... E05B 25/00

[52] U.S. Cl. ..... 70/358; 70/364 A; 70/383

[58] Field of Search ..... 70/383, 364 A, 358, 70/382, 384

[56] References Cited

U.S. PATENT DOCUMENTS

| | | | |
|---|---|---|---|
| 3,462,983 | 8/1969 | Evanish | 70/383 |
| 4,094,175 | 6/1978 | Pechner | 70/364 A |

*Primary Examiner*—Robert L. Wolfe

*Attorney, Agent, or Firm*—Lewis B. Sternfels

[57] ABSTRACT

Extending between the plug and the housing of a pin tumbler lock are two diagonally opposed rows of columnated locking tumbler pins with or without master pins which establish two individual shear lines between the housing and the plug. An operating key, which is insertable centrally within the plug in a single orientation therewith, is provided with a pair of bitted surfaces which respectively contact the columnated pins in the respective rows. The columns of the master pins and locking tumbler pins in a first of the rows have thicknesses and numbers which may be collectively different from those of the columns of the wafers and locking tumbler pins in a second of the rows to form a unique coupling arrangement along each of the shear lines between the plug and the housing. The above structure including the two rows is combined with the invention described in co-pending patent application, Ser. No. 752,084, filed Dec. 20, 1976, now U.S. Pat. No. 4,094,175, patented Jun. 13, 1978, entitled "Internal Tumbler Lock Key Change System" to provide an improvement thereof.

30 Claims, 7 Drawing Figures

Fig. 1.
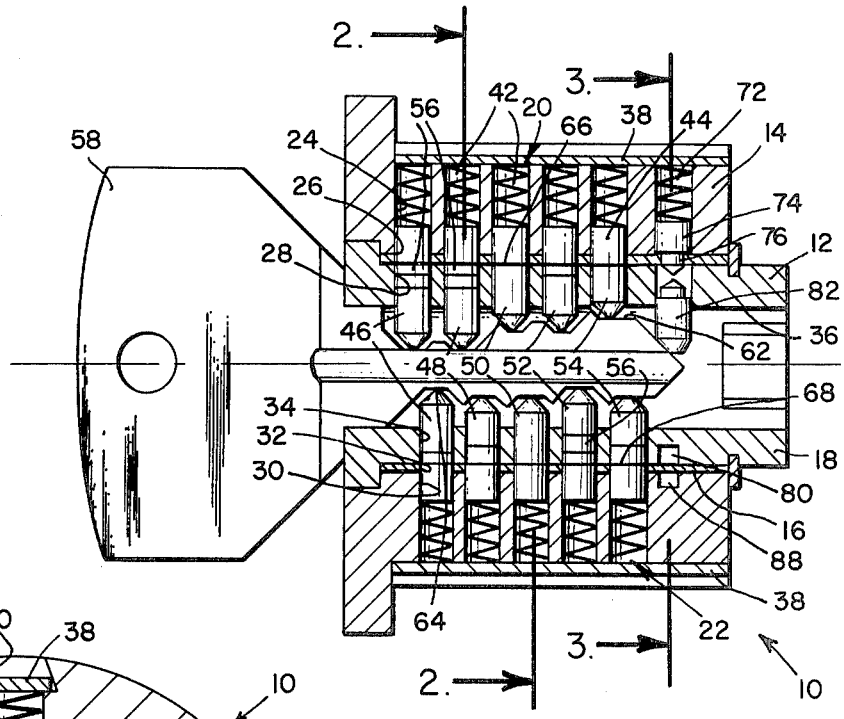
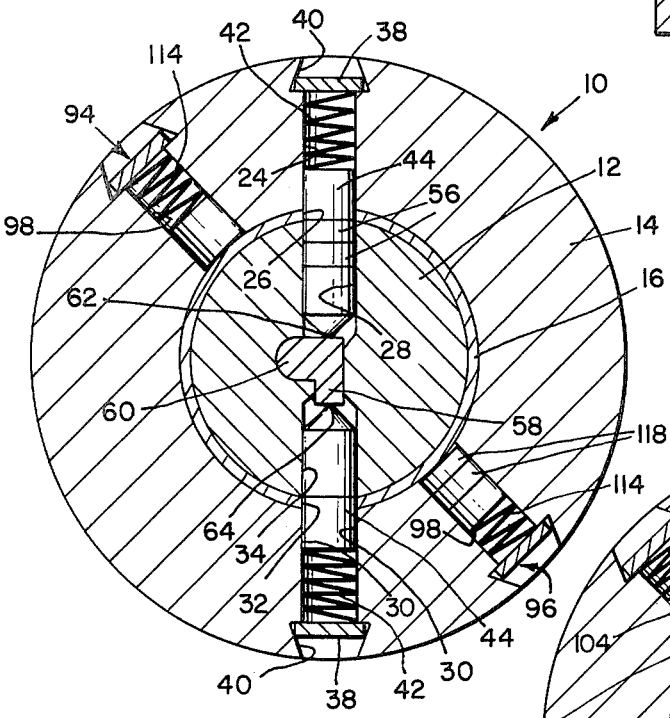
Fig. 2.
Fig. 3.
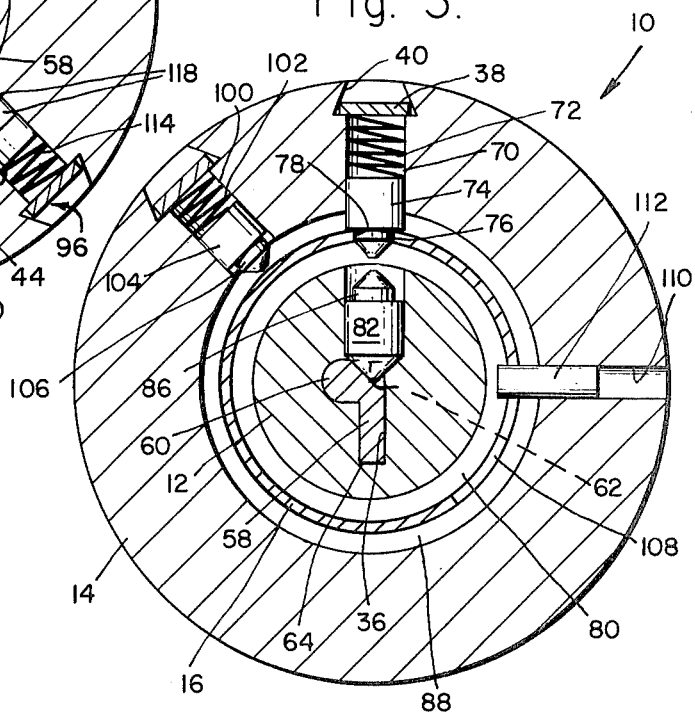

Fig. 4.
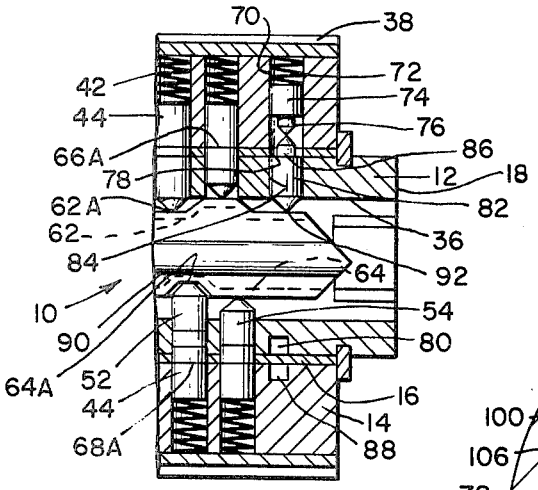
Fig. 5.
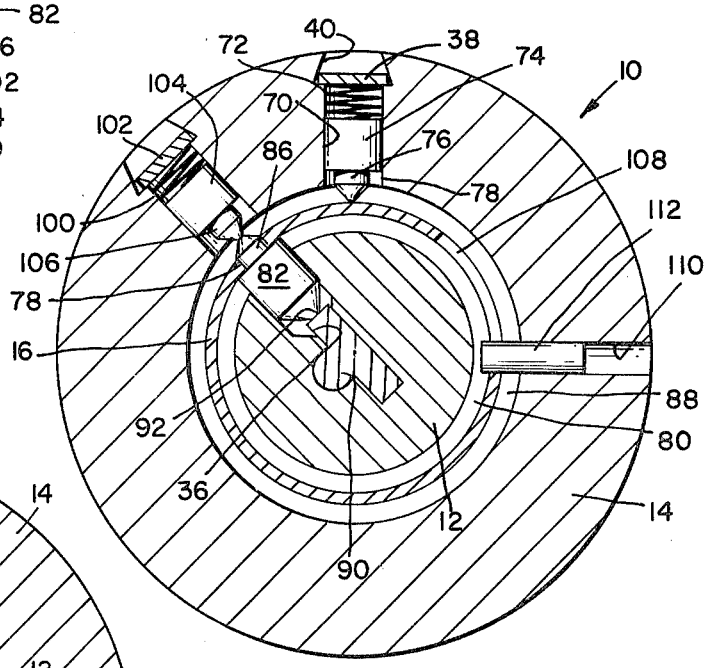
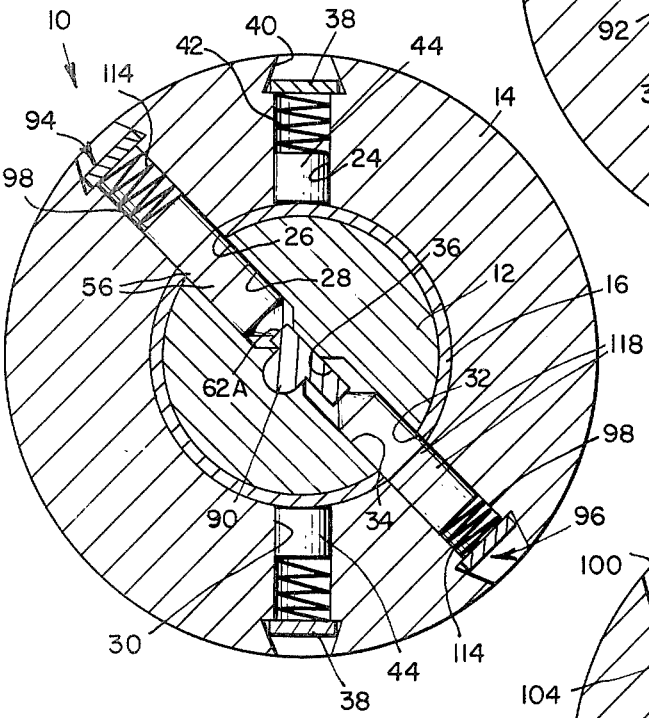
Fig. 6.
Fig. 7.
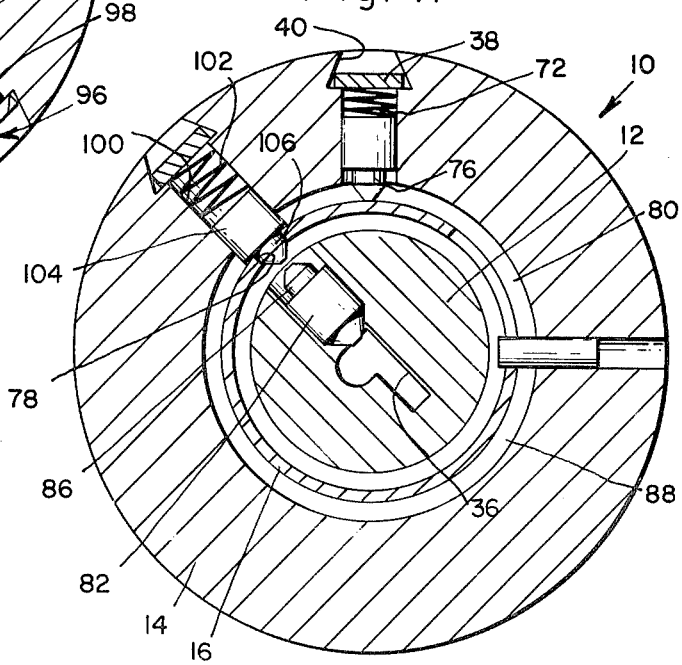

KEY-OPERATED PIN TUMBLER LOCK

BACKGROUND OF THE INVENTION

The present invention is an improvement over my co-pending application, Ser. No. 752,084, filed Dec. 20, 1976, entitled now U.S. Pat. No. 4,094,175, patented June 13, 1978, "Internal Tumbler Lock Key Change System."

1. Field of the Invention

The present invention relates to a key-operated pin tumbler lock and, more particularly, to such a lock having vastly expanded capacity for increasing the number of unique lock changes.

2. Description of the Prior Art

Key operated locks are adapted to permit their operations by different combinations and uniquely configured keys therefor. As the number of combinations increase, the number of uniquely configured keys therefor increase, albeit not in direct proportion. It is accordingly possible to secure a large number of enclosures without use of the same combinations. For example, for a conventional tumbler pin cylinder lock utilizing a five pin system with a single bottom pin and a single top pin in each of the five pin chambers, the lock combination is one. When master pins are added to a chamber, for x master pins added to n chambers, the lock combination may be expressed by the formula: $(x+1)^n$. However, as the number of master pins increase, it becomes easier to pick the lock. Therefore, it is preferable to utilize not more than two master pins per chamber. For a system based upon a maximum of two master pins and one bottom pin per chamber, the number of combination is $3^5$, or 243 combinations.

Of these 243 combinations, all may be operated by a single key, called a master key. Some keys in this number of combinations bypass others, but 51 of them are distinct from all others. Such a system may be useful in such buildings as apartment houses and office buildings. In other buildings, however, it may be desireable to have more than one master key, such as in a hotel, where there may be one master key per floor and one grand master key for all floors. In such a situation, for a building requiring 2–5 master keys, and one grand master key, the number of unique distinct operating keys is reduced to 13. In a like manner, for one great grand master key, there would be 2 grand master keys, 10 master keys, and 7–8 distinct operating keys. From the above, it is apparent that there are limitations when it is desired to utilize master, grand master and great grand master key levels.

Added to this limitation, tumbler pin cylinder locks have been devised so that their combinations may be changed for use with different keys, such as may be required in buildings with many offices or rooms, occupied at different times by various tenants, as in hotels, apartments and office buildings. In prior art locks for such systems, changes were usually effected by removing the lock from its emplacement to make the changes.

SUMMARY OF THE INVENTION

The present invention overcomes or avoids these and other limitations or problems by adding at least one additional row of columnated tumbler pins with or without master pins to a tumbler pin cylinder lock. It is preferred that the two rows be diametrically opposed from one another so that the operating key may utilize both sides for bitting so that the two bitted surfaces are contactable with the columnated pins, without requiring any great changes in the conventional shapes of keys and locks. However, should it be so desired, the keys may be made having an H-shape, a X-shape, etc. Thus, the present invention envisions the expansion of the conventional single shear line between the plug and housing to two or more shear lines,depending upon the number of rows of columnated pins.

In order to insure that there be a maximum number of combinations possible, the columnated pins of each row may be sized and numbered differently, collectively as a whole, from those of the other row or rows. Each of the operating key's bittings will also be uniquely configured for its mating row of columnated pins. Therefore, the present invention enables the old system's combination of 51 distinct operating keys for one master key to be expanded 243 times to a total ($51\times243$) of 12,393 distinct operating keys.

The present invention is adapted to be combined with that described in above-noted co-pending patent application, Ser. No. 752,084 now U.S. Pat. No. 4,094,175, entitled "Internal Tumbler Lock Key Change System". In that invention, an auxiliary row of reserve master pins are arranged in alignment with and angularly offset from the lock operating row of columnated pins to which master pins may be added or removed. Such an auxiliary row of reserve master pins is directed to be combined with the present invention. In addition, there may be as many auxiliary rows of reserve master pins as there are operating lock rows of columnated pins so that the number of combinations attainable, for all practical purposes, becomes infinite. In this combined system, a lock-combination changing key would also make use of an additional pin engaging surface.

Thus, for a four level system based upon the illustrative system comprising 12,393 distinct operating keys, at the great grand master level, there is one great grand master key which is unchangeable, 10 grand master keys which are changeable in situ, 25 master keys which are also changeable in situ, and over 1,000 distinct operating keys for any master key. While it is possible to go beyond the great grand master key level, there is no present reason to advance beyond these four levels. There would be one lock-combination changing key for each lock operating key.

It is, therefore, an object of the present invention to provide for an improved key-operated pin tumbler lock system.

Another object is to provide for such a system having substantially unlimited number of combinations in single level and multiple levels utilizing master keys, grand master keys, etc.

Another object is to provide for such a system incorporating substantially unlimited variations in combination changes.

Another object is to provide for such a system in which key changes are made entirely internally within the lock, without use of tools and without need to remove the lock from its emplacement.

Other aims and objects as well as a more complete understanding of the present invention will appear from the following explanation of exemplary embodiments and the accompanying drawings thereof.

BRIEF DESCRIPTION OF THE DRAWINGS

FIG. 1 is a side elevational, partially cross-sectional view of the present invention, taken in combination with the invention described in co-pending patent application Ser. No. 752,084 U.S. Pat. No. 4,094,175, which is operated by a five-pin operating key and whose combination is changeable by a six-pin changing pin;

FIG. 2 is a cross-sectional view illustrating the structure for use with an operating key, taken along lines 2—2 of FIG. 1;

FIG. 3 is a cross-sectional view illustrating structure for use with an operating key, taken along lines 3—3 of FIG. 1;

FIG. 4 is a cross-sectional view similar to that of FIG. 1 illustrating replacement of the operating key thereof by a lock-combination changing key;

FIG. 5 is a cross-sectional view, similarly taken as that depicted in FIG. 3, but with the lock-combination changing key rotated to the combination changing position of the lock;

FIG. 6 is a cross-sectional view similar to that of FIG. 2, but with the lock-combination changing key in position, the changing key having positioned the lock in alignment with its auxiliary reserve master pins; and FIG. 7 is a cross-sectional view similar to that depicted in FIG. 5, but with the lock-combination changing key removed from the lock, which is in readiness for reception of a different lock-combination changing key.

DESCRIPTION OF THE PREFERRED EMBODIMENTS

Referring again to the drawings, there is shown in FIGS. 1-3 a pin tumbler cylinder lock 10, having a generally cylindrical locking and unlocking plug 12, a cylinder or housing 14, and a cylindrical shutter or sleeve 16, the plug being adapted to rotate within the shutter during normal locking operations and being adapted to rotate with the shutter within the cylinder during key changing operations.

Cylinder 14 may be threadedly or otherwise engaged within a lock frame, for example, within a door, and the inner end of the plug at 18 is adapted to engage means for throwing a bolt or releasing a latch which projects from and turns with the plug to lock or unlock the latch or bolt.

As shown in FIGS. 1, 2, 4 and 6 the cylinder, the shutter, and the plug respectively have two rows 20 and 22 of five axially aligned cylindrical locking bores 24, 26 and 28 in row 20 and locking bores 30, 32 and 34 in row 22. Within the plug, radially and axially aligned with the two rows of five locking bores, is a key slot 36. The locking bores in cylinder 14 extend from the outer periphery thereof, as shown in FIG. 1, so that the bores may be loaded from the outside. Bars 38, held within grooves 40 having sloped side walls cut in the cylinder's outer periphery, close off the bores. The shutter normally closes the lower ends of the housing auxiliary bores.

Within the respective housing locking bores 24 and 30 are springs 42 in abutment at one of their ends with bars 38 at the outer periphery of the cylinder. At the other ends of the springs are cylindrical top tumbler pins 44 slidably fitted within bores 24 and 30 and adapted to be moved outwardly toward the springs by a key, and adapted to be moved inwardly in the cylindrical shutter and plug bore rows 20 and 22, respectively, when a key is not in the slot. Each top tumbler pin 44 is generally made to be of the same length.

At the inner ends of each of locking bore rows 20 and 22 are five bottom, cylindrical, tumbler pins 46, 48, 50, 52 and 54, having convex ends and, when a key is not in slot 36, their lower convex ends rest at the bottoms of plug bores 28 and 34 where they are held by the force of springs 42. According to the operating key design, bottom tumbler pins 46, 48, 50, 52 and 54 may be of various lengths not only within their individual rows 20 and 22 but also between the two rows. Further, according to the operation key design, master pins 56 are inserted between top tumbler pins 44 and bottom tumbler pins 46, 48, 50, 52 and 54; the top, master and bottom pins being biased together in columns by springs 42. The master pins may be of varying thickness or of the same thicknesses and varied in number in one or more locking bores. In the cases of both bottom tumbler pins 50 of different lengths, according to the specific key design, no master pins are used in their locking bores.

As shown in FIGS. 1-3, an operating key 58 is inserted in slot 36 in its operating position for locking and unlocking lock 10. As shown in FIGS. 2 and 3, the key has a laterally configured ridge 60 so that the key is adapted to enter slot 36 axially and in only one orientation with respect to plug 12 so that it is capable of contacting its proper row of columnated pins.

On the respective upper and lower edges of the five-pin key, for example, are predetermined high and low pin facing contact or bitted surfaces 62 and 64. These surfaces engage the lower convex ends of bottom tumbler pins 46, 48, 50, 52 and 54, respectively of rows 20 and 22, so as to form a pair of shear lines 66 and 68 between operating pins, whether master, top or bottom pins, on the interior cylindrical wall of shutter 16 so that rotation of the key will permit rotation of plug 12 within shutter 16 to perform the locking or unlocking function.

In axial alignment with one row of five locking bores is a sixth bore 70 within housing 14, having therein a spring 72, and in a biasing relationship at the lower end of the spring is a first shutter holding pin 74, as seen in FIGS. 1, 3 and 4. Shutter holding pin 74 has a smaller diameter portion 76 terminating in a conical point. In FIGS. 1, 3 and 4 small diameter portion 76 is biased into a sixth position shutter bore 78, smaller in diameter than the other five position shutter bores 26 and 32, and the shoulder on pin 74, outwardly of the small diameter portion, rests on the outer cylindrical surface of the shutter.

In radial and transverse alignment with shutter holding pin bore 78 is an annular groove 80 in the outer surface of plug 12, with the conical end of portion 76 of pin 74 extending into groove 80. Thus, when shutter holding pin 74 is extending through shutter bore 78, the shutter is locked against rotation for operation with five-pin key 58. Extending inwardly from groove 80 in radial alignment with sixth position bore 70, and in axial row alignment with locking bore rows 20 and 22, is a shutter releasing and rotating pin 82. As shown in FIGS. 1-3, when five-pin key 58 is in plug 12, the convex bottom of pin 82 rests on the bottom of a sixth position bore 84 of the plug. Pin 82 has an upper reduced diameter portion 86, terminating in a conical end, reduced portion 86 being adapted to fit within shutter bore 78.

As shown in FIGS. 1 and 3, shutter holding pin 74 extends into a cutaway annular cavity 88 in the housing, radially outwardly of and in alignment with groove 80. Cavity 88 provides clearance for the rotation of the end of shutter releasing and holding pin 82 when the end is extending into shutter bore 78 and the plug and shutter are rotated during the lock-key changing operation, to be described shortly.

Shown in FIG. 4 is a six-pin lock-combination changing key 90, corresponding to operating key 58, having an additional sixth upper edge operating contact or bit surface 92.

Changing key 90 is otherwise identical to the operating key 58 except that its double sided, five bitted or contacting surfaces, corresponding to surfaces 62 and 64 are respectively regularly higher, as 62A and 64A, in FIG. 4, corresponding to surfaces 62 and 64 in FIG. 1, to raise the pair of shear lines to 66A and 68A of all the pins which appear to be just on the outer cylindrical wall of shutter 16.

After the operating key has been removed, changing key 90 is inserted into slot 36 for the purpose of changing the lock combination for operation by a new operating key. Changing key surface 92 moves shutter releasing and rotating pin 82 in the plug upwardly against shutter holding pin 74, moving small diameter portion 76 of pin 74 out of shutter bore 78 and moving small diameter portion 86 of pin 82 therein, as shown in FIG. 4. The two pairs of bitted surfaces 62A and 64A raise appropriate master pins 56 and tumbler pins 50 and 54 into shutter bores 26 and 32 to form new shear line 66A, as illustrated in FIG. 4. In this situation changing key 90 is adapted to rotate the plug and the shutter together within the housing, the conical end of reduced portion 86 of pin 82 being adapted to rotate in cavity 88.

As shown in FIGS. 2 and 6, angularly offset from both locking bore rows 20 and 22 and sixth position shutter holding pin bore 70 in housing 14 are two rows 94 and 96 respectively of five axially aligned auxiliary or reserve master pin bores 98. Aligned with row 94 is a sixth bore 100 (FIGS. 3, 5 and 7) which forms a second shutter holding pin bore containing a spring 102 and a second shutter holding pin 104, having a small diameter portion 106 terminating in a conical end. Bore rows 94 and 96 are in transverse alignment respectively with five locking bore rows 20 and 22 and bore 100 is in alignment with sixth position bore 70, so that precise rotation of the plug and the shutter will radially align their locking bores with their respective auxiliary bores. During normal locking operation, the conical end of portion 106 of second shutter holding pin 104 rests on the outer surface of the shutter 16, as shown in FIG. 3.

It is important that the rotation of the plug and the shutter be precise with respect to locking and auxiliary bore rows 20, 22 and 94, 96. Accordingly, as shown in FIGS. 3 and 5, a slot 108 extends through the surface of shutter 16 in alignment with grooves 80 and 88. The slot has about the same width as the diameter of shutter bore 78. Threadedly engaged within a bore 110 in housing 14 as shown in FIGS. 3 and 5, is a set screw or pin 112 which extends through slot 108 and into groove 80. The engaging end of pin 112 is in abutment with the upper end of slot 108, in which position shutter holding pin 74 is in its shutter locking position to hold shutter 16 against rotation.

When lock-combination changing key 90 is turned to rotate plug 12 and shutter 16 counterclockwise, having moved small diameter portion 86 of shutter releasing and rotating pin 82 into shutter bore 78, the conical end of pin 82 rotates in cavity 88 to engage the conical end of second shutter holding pin 104, moving pin 104 outwardly against the force of spring 102. The limit of this rotation is determined by the lower end of slot 108 which is then in contact with the lower end of pin 112. At this point shutter and plug bores 26, 28 and 32, 34 are respectively radially aligned with auxiliary bores 98 of auxiliary rows 94 and 96. When the changing key is then removed as shown in FIG. 7, small diameter portion 106 of pin 104 moves into shutter bore 78 to engage the small diameter portion therewith and to lock shutter 16 in the key changing position.

During the rotation of shutter 16 and plug 12 by changing key 90, as illustrated in FIG. 4 for pins 52 and 54, all bottom tumbler pins 46, 48, 50, 52 and 54 and master pins 56, as raised by the changing key, remain radially in place with respect to the shutter and the changing key.

In each of five reserve master pin bores 98 of auxiliary rows 94 and 96 as illustrated in FIGS. 2 and 6, there are springs 114 extending against top tumbler reserve pins 116. At their lower ends reserve master pins 118 may be positioned. Because it is preferred that not more than two master pins exist in any locking bore, there are no reserve master pins in the particular auxiliary bore 98 for row 94 shown in FIG. 2, as there already are two master pins 56 in bore 28 of row 20. The converse is depicted for bore 34 of row 22 and auxiliary bore 98 of row 96. Thus, when first changing key 90 is removed from plug slot 36 (see FIG. 7), a second six-pin changing key can then be inserted into the slot, and the master pins 56 and 118 in the various plug bores and reserve bores will be moved upwardly or downwardly in aligned bores 98, 26, 28 and 98, 32, 34 in accordance with the shape of the key, so that a new locking combination along shear lines 66A and 68A on the outer cylindrical wall of the shutter is formed to permit rotation by the new lock-combination changing key. The new combination changing key is properly bitted to allow the tumbler/master/top pins in the reserve rows to form shear lines for each auxiliary bore just outwardly of the cylindrical walls of bores 26 and 32 of the shutter.

Thus, the new six-pin changing key is adapted to rotate the plug and the shutter clockwise back to the position shown in FIGS. 3 and 4 but with a different columnar arrangement of tumbler and master pins than that shown, with pin 82 remaining within shutter bore 78. When the new six-pin changing key is removed from key slot 36, spring 72 in housing holding pin bore 70 moves shutter holding pin 74 back into its shutter locking position, and shutter releasing and rotating pin 82 drops down into the position as shown in FIGS. 1 and 3. At this point a new operating key, corresponding to the structure of the new six-pin changing key but having five bits on each edge, can then be inserted into the key slot to operate the lock.

As may be seen, a multiplicity of key changes can be made depending upon the thickness and numbers of master pins 56 and 118 in bores 24 and 30 and auxiliary bores 98. In each case the changing key must be adapted to position and number the pins to form a pair of shear lines so as to permit the rotation of the plug and the shutter back to the operating position and to permit rotation of the plug by the operating key while the shutter remains stationary.

The invention and its attendant advantages will be understood from the foregoing description and it will be apparent that various changes may be made in the form, construction and arrangement of the parts of the invention without departing from the spirit and scope thereof or sacrificing its material advantages, the arrangements hereinbefore described being merely by way of example. I do not wish to be restricted to the specific forms shown or uses mentioned except as defined in the accompanying claims, wherein various portions have been separated for clarity of reading and not for emphasis.

What is claimed is:

1. In a key-operated pin tumbler lock having a housing, a plug movable therein, means including at least two shear lines between said housing and said plug, means including elements disposed in columns in at least two rows respectively positioned along said shear line means in a unique lock combination and selectively movable in said housing and said plug into blocking and unblocking positions therebetween respectively for coupling said plug to said housing to prevent relative movement therebetween and for uncoupling said plug from said housing to permit relative movement therebetween, an operating key insertable in said plug and having means respectively contactable with said elements along each of said shear line means for selectively moving said elements from their blocking positions and into their unblocking positions in accordance with the unique combination, and means in and between said housing and said plug for changing the unique lock combination to another lock combination, the improvement in which:

said columns of said elements of a first of said rows are axially alternating from said columns of said elements of a second of said rows, to prevent miscoupling respectively of said contactable means of said key with said first row elements and with said second row elements when said key is fully inserted in said plug.

2. The pin tumbler lock of claim 1 wherein said columns of said elements in said first of said rows have thicknesses and numbers which may be collectively different from those of said columns of said elements in said second of said rows for forming uniquely formed coupling arrangements between said plug and said housing of said rows along said respective shear lines means.

3. The pin tumbler lock of claim 2 wherein said operating key means comprise at least first and second surfaces respectively couplable to said elements.

4. The pin tumbler lock of claim 1 wherein said key includes means co-operable with said plug for permitting insertion of said key therein in a single radial orientation therewith, further for preventing said miscoupling.

5. The pin tumbler lock of claim 1 wherein said lock combination changing means comprises:

a shutter between said housing and said plug and relatively moveable therewith between at least two positions;

means normally coupling said shutter with said housing to prevent relative movement therebetween and movement of said shutter between its positions, said coupling means being not adapted to be operated by said operating key when said operating key moves said plug to lock and unlock the lock; and second means in said housing, said shutter, and said plug and coupleable with a lock-combination changing key to permit said lock-changing combination key to move said plug and said shutter in said housing and to permit the unique combination to be changed to another unique combination, said coupling means being operable by said lock-combination changing key.

6. The pin tumbler lock of claim 5 wherein said second means includes reserve elements in said housing; said reserve elements being capable of being added to said first mentioned means and said first-mentioned elements of said first-mentioned means being capable of being received by said second means, by said lock-combination changing key.

7. The pin tumbler lock of claim 6 wherein said second means extend along at least two additional shear lines between said housing and said shutter, with said reserve elements being disposed in reserve columnar means in at least two reserve rows, said reserve columnar means of said reserve rows being disposed respectively adjacent to said first-mentioned rows respectively for addition of said reserve elements thereto and for reception of said first-mentioned elements therefrom.

8. The pin tumbler lock of claim 1 further comprising:

a cylindrical opening in said housing in which said plug is rotatable;

said means including said elements including a pair of rows respectively of axially aligned locking bores in said housing and said plug;

a key slot in said plug in alignment with said bores; and each of said locking bores having space for springs, master pins, and tumbler pins adapted to be positioned and sized to permit said plug to be operated with said operating key to lock and unlock the lock when said operating key is inserted into the slot, said springs being adapted to bias said pins toward the key slot;

said lock combination changing means comprising:

at least two rows of axially aligned auxiliary bores in said housing respectively angularly offset from and transversely aligned with respective locking bores;

each of said auxiliary bores adapted to have springs and master pins therein, said springs being adapted to bias said master pins inwardly toward the plug;

a relatively thin-walled shutter sleeve fitted for rotation in said cylindrical opening in said housing in which said plug is fitted for rotation therein and therewith, at least two rows of axially aligned locking bores in said shutter sleeve in respective radial and axial alignment with the locking bores in said housing and said plug;

first means within said housing and said shutter to prevent rotation of said shutter during operation of the lock when said operating key rotates said plug to lock and unlock the lock; and second means within said housing, said shutter, and said plug actuated by a lock-combination-changing predetermined key to permit said lock-combination-changing predetermined key to rotate said plug and said shutter in said housing from the operating position of the lock to a combination-changing position of the lock by respectively aligning said pair of rows of said locking bores in said plug and said shutter respectively with said two rows of said auxiliary bores in said housing.

9. The pin tumbler lock according to claim 8, including:

third means within said housing and said shutter to hold the locking bores in said shutter in alignment with the auxiliary bores in said housing when said changing predetermined key is removed from the slot.

10. The pin tumbler lock according to claim 9, including:

means within said housing and said shutter to precisely align the locking bores in said shutter and said plug with respective ones of the auxiliary bores when a changing predetermined key is used to rotate for such alignment.

11. The pin tumbler lock according to claim 9, including:

means within said housing and said shutter for precisely aligning the locking bores in said shutter and said plug with the locking bores in said housing when a changing predetermined key is used to rotate the shutter and plug locking bores into respective alignment with the housing locking bores.

12. The pin tumbler lock according to claim 8, in which:

master pins may be added to or removed from the respective locking bores in said plug in accordance with the shape of a predetermined changing key inserted into the key slot when the plug bores are in respective alignment with the auxiliary bores;

said master pins and/or tumbler pins in each case being adapted to form shear lines adjacent the outer cylindrical wall of said shutter to permit its rotation by rotation of said changing key.

13. The pin tumbler lock according to claim 12, in which:

after said last predetermined changing key has rotated the plug and shutter locking bores into alignment with the housing locking bores, and said changing key has been removed, a predetermined operating key corresponding to the changing key will operate the lock.

14. The pin tumbler lock according to claim 8, in which:

said first means is a first shutter holding pin within a housing shutter pin bore, said first shutter holding pin being not adapted to be operated by an operating key and being spring biased into a shutter holding bore;

said first means being operable by predetermined changing key within and associated with said second means.

15. The pin tumbler lock according to claim 14, in which:

said first shutter holding pin and said housing shutter pin bore are axially aligned with one of said rows of locking bores in said housing, said shutter, and said plug;

said second means including a shutter releasing and rotating pin within said plug in axial alignment with said one of said locking bore rows and in radial alignment with the shutter holding bore.

16. The pin tumbler lock according to claim 15, in which:

said second means further includes an annular groove in said plug in substantial radial and axial alignment with said first shutter holding pin, the housing shutter pin bore, the shutter holding bore, and said shutter releasing and rotating pin when said second means is in the normal lock operating position; and an annular cavity portion enlarging the cylindrical opening in said housing being radially outwardly of the groove, a portion of said shutter, and said shutter releasing and rotating pin;

said annular cavity portion being effectively axially alignable with said first shutter holding pin, the housing shutter pin bore, the shutter holding bore, said shutter releasing and rotating pin, and said third means;

said annular cavity portion being adapted to permit the rotation of said plug and said shutter so that the locking bores in the shutter and plug are rotated into alignment with said auxiliary bores when said shutter releasing and rotating pin is in the shutter holding bore and said plug, and said shutter is rotated by a predetermined changing key acting on said shutter releasing and rotating pin.

17. The pin tumbler lock according to claim 16, including:

third means in axial row alignment with the auxiliary bores in said housing and in radial alignment with said annular cavity portion;

said third means including a bore in said housing and having a second shutter holding pin therein spring biased to force said second holding pin into the shutter holding bore when said shutter and said plug have been rotated by a predetermined changing key to align said shutter releasing and rotating pin and the shutter holding bore into alignment with said second holding pin and said predetermined changing key has been removed.

18. The pin tumbler lock according to claim 17, in which:

said first and second shutter holding pins and said shutter releasing and rotating pin have reduced diameter end portions adapted to fit into said shutter holding bore;

said pins having enlarged diameters inwardly of the reduced diameters to limit penetration of the enlarged diameters into the shutter holding bore.

19. The pin tumbler lock according to claim 18, including:

a fixed limiting pin in said housing being adapted to limit the rotation of said shutter;

said shutter having an annular slot of predetermined length through its cylindrical surface;

said limiting pin extending into the slot;

the slot and said limiting pin being adapted to align the locking bores in said shutter and said plug with the auxiliary bores when a changing predetermined key is used to rotate said shutter and plug for such alignment;

the slot and said limiting pin being adapted to align the locking bores in said shutter and said plug with the locking bores in said housing when a changing predetermined key is used to rotate the shutter and the plug locking bores into alignment with the housing locking bores.

20. The pin tumbler lock according to claim 8, in which:

said each lock operating key corresponds to a changing key for lock operation; and each new changing key corresponds to a new operating key.

21. The pin tumbler lock according to claim 9 in which:

each predetermined lock operating key is incapable of operating said second means;

each lock operating key corresponds to a predetermined lock changing key adapted to operate said second means.

22. The pin tumbler lock according to claim 9, in which:

a new predetermined lock operating key is determined by the insertion of a new predetermined changing key into the slot when said third means is holding said shutter in alignment with the auxiliary bores after a prior changing key has been removed from the slot.

23. The pin tumbler lock according to claim 8, in which:

said master pins and/or tumbler pins in each bore being adapted to form a pair of shear lines inside the shutter for rotation of said plug within said shutter by rotation of an operating key.

24. The pin tumbler lock according to claim 8, in which:

master pins may be added to or removed from the locking bores in said plug in accordance with the shape of a predetermined changing key inserted into the key slot when the plug bores are in respective alignment with the auxiliary bores.

25. The pin tumbler lock according to claim 8, in which:

said master pins and/or tumbler pins in each locking bore being adapted to form a pair of shear lines outside said shutter when a changing key is in the key slot.

26. A key-operated pin tumbler lock with integral combination changing means not requiring removal of the lock from its emplacement of use comprising in combination:

a plurality of pairs of uniquely configured lock operating keys and lock combination changing keys;

a housing;

a plug rotatable in said housing and having a key-receiving slot for receiving any of said keys;

first means including two rows axially alternating of elements in and extending between said plug and said housing and cooperable with a selected pair of said keys for establishing a unique locking and unlocking rotational engagement between said plug and said housing;

second means including two similarly axially alternating rows of reserve elements in said housing cooperable with said lock combination changing keys for adding said reserve elements respectively to and for subtracting said first means elements respectively from said two rows of said first means, for changing the unique locking and unlocking rotational engagement to other different but unique engagements;

a shutter positioned between said housing and said plug; and third means normally securing said shutter and said housing together and capable of engagement only by said lock combination changing keys, wherein said lock combination changing key of said selected pair of said keys, said third means and said first means elements cooperate to release said shutter for rotation with said plug, thereby for enabling the adding of said reserve elements respectively to and the subtracting of said first means elements respectively from said two rows of said first means upon replacement of said lock combination changing key of said selected pair of said keys with another of said combination changing keys.

27. The key-operated lock of claim 26 wherein said third means is axially displaced from said first means along said plug, said shutter and said housing, said lock combination changing keys and said lock operating keys each have a pair of bitted surfaces respectively for contact with said first means elements in said two rows, and said lock combination changing keys each have an additional bit for contact with said third means.

28. The key-operated lock of claim 27 wherein said shutter has a discrete thickness and said bitted surfaces of said lock combination changing keys are higher than said bitted surfaces of said lock operating keys to an extent equalling the sleeve discrete thickness.

29. The key-operated lock of claim 27 wherein said bitted surfaces of a first of said pair, in conjunction with the row of first means elements, terminate at levels which are collectively different from the termination levels of said bitted surfaces of a second of said pair, in conjunction with its row of first means elements.

30. A key-operated pin tumbler lock with integral combination changing means not requiring removal of the lock from its emplacement of use comprising in combination:

at least two pairs of keys, each pair including a uniquely configured lock operating key and a lock combination changing key, each having at least two axially alternating lock releasing bitted surfaces;

a housing;

a plug rotatable about an axis in said housing and having a key-receiving slot for individually receiving said keys;

first means forming at least two shear lines which extend generally parallel to the axis between said plug and said housing and which are radially spaced from one another about the axis, said first means being cooperable with said plug and said housing and having similarly axially alternating means which are engageable by said lock operating key and said bitted surfaces thereof for establishing a unique locking and unlocking rotational engagement between said plug and said housing;

second means cooperable only with said lock combination changing key for enabling the unique locking and unlocking rotational engagement to be changed to another different but unique engagement;

a shutter positioned between said housing and said plug; and third means normally securing said shutter and said housing together and adapted to be engaged only by said lock combination changing key, said third means being cooperable with said lock combination changing key and said first means to release said shutter for rotation with said plug, thereby changing the unique locking and unlocking rotational engagement to the other different but unique engagement upon replacement of said lock combination changing key with another lock combination changing key.

* * * * *